US006290156B1

(12) United States Patent
Jeffrey

(10) Patent No.: US 6,290,156 B1
(45) Date of Patent: Sep. 18, 2001

(54) METHOD AND APPARATUS FOR WINDING ELONGATE STRAND MATERIAL AND PACKAGE OF WOUND MATERIAL

(76) Inventor: C. Allan Jeffrey, 620 Hilton Street, Winnipeg, MB (CA), R3R 0Y9

( * ) Notice: Subject to any disclaimer, the term of this patent is extended or adjusted under 35 U.S.C. 154(b) by 0 days.

(21) Appl. No.: 09/407,874

(22) Filed: Sep. 29, 1999

(51) Int. Cl.[7] ..... B65H 18/28; B65H 18/08

(52) U.S. Cl. ..... 242/171; 242/471; 242/472.5; 242/532.5

(58) Field of Search ..... 242/530.1, 532.5, 242/532.6, 472.5, 171, 178, 471

(56) References Cited

U.S. PATENT DOCUMENTS

| | | | | |
|---|---|---|---|---|
| 2,082,489 | * | 6/1937 | Goldsmith | 242/471 |
| 2,677,510 | | 5/1954 | Osborne . | |
| 3,254,862 | * | 6/1966 | Bates et al. | 242/471 |
| 3,294,335 | * | 12/1966 | Schiebeler et al. | 242/471 |
| 3,677,490 | * | 7/1972 | Gordon et al. | 242/171 X |
| 4,193,563 | | 3/1980 | Vitale . | |
| 4,586,675 | | 5/1986 | Brown . | |
| 4,687,154 | | 8/1987 | Deweese . | |
| 5,335,687 | | 8/1994 | Odom . | |
| 5,402,814 | | 4/1995 | Odom . | |
| 5,823,459 | * | 10/1998 | York | 242/471 |

* cited by examiner

*Primary Examiner*—Michael R. Mansen
(74) *Attorney, Agent, or Firm*—Murray E. Tarift

(57) ABSTRACT

A method and apparatus to wind hose into a hose package such that the hose may later be dispensed from the hose package without twisting. The apparatus includes a drum for winding the hose thereon and an indexer for feeding the hose onto the drum such that the hose forms the hose package. The hose package includes a plurality of first loops forming a first coil adjacent a first end of the drum and a plurality of second loops forming a second coil adjacent a second end of the drum. The first and second loops are alternately formed such that the hose extends from the first coil to the second coil at a crossover point between the coils after each loop is formed. When the hose package is removed from the apparatus an inner end of the hose is inserted between the first and second coils past a periphery of the coils. In this arrangement, the hose may be drawn out from the hose package without twisting of the hose.

11 Claims, 5 Drawing Sheets

METHOD AND APPARATUS FOR WINDING ELONGATE STRAND MATERIAL AND PACKAGE OF WOUND MATERIAL

FIELD OF THE INVENTION

This invention relates to a method and apparatus for winding elongate strand material and a resulting package formed by the method and apparatus for later dispensing the material from the package without twisting.

BACKGROUND

It is common practice to wind up hose and other similar strand materials such as wire and cable into a coil for compact storage. When the hose is later dispensed from the coil, a reel of some type is generally required to prevent twisting of the hose or other material as it is unwound.

U.S. Pat. No. 2,677,510 to Osborne describes a method and apparatus for handling and storing hose. The apparatus consists broadly of a pair of semi-circular reel bases which in the winding position of the device, may be laid out and spaced apart a short distance so that a strand may be laid or wound thereon in the form of a figure eight. The strand, starting with the last end laid in, may be drawn out linearly without kinks or any tendency to snarl.

Winding the hose onto the apparatus of Osborne however is awkward and time consuming as the hose must be laid out manually in the figure eight pattern. For later unwinding the hose, a frame is required to support the hose in the figure eight pattern such that a separate apparatus is required for each hose which requires dispensing when multiple lengths of hose are to be dispensed.

SUMMARY

According to one aspect of the present invention there is provided an apparatus for winding an elongate strand of material into a coil, the apparatus comprising;

a drum supported for rotational movement, the drum having a peripheral surface with a first end, a second end opposite the first end and a crossover point on the peripheral surface spaced between the first and second ends; and an indexer for dividing the peripheral surface into a first portion between the first end and the crossover point and a second portion between the second end and the crossover point, the indexer being open between the first and second portions at the crossover point.

The use of the drum allows hose to be wound into a coil quickly without requiring awkward manipulation of the hose. The resulting coil of hose is portable without the need of a carrier or frame for supporting the hose as the hose is wound tightly into an open core hose package. The hose is dispensed from the hose package from an inner end of the hose without twisting because the hose is alternately drawn from the first and second portions of the coil. In this arrangement, any twisting imposed on the hose from drawing it from the first portion of the coil is countered by twisting the hose in an opposite direction as it is subsequently drawn from the second portion of the coil. The resulting length of hose drawn from the hose package is thus substantially free of unwanted twists. The use of a drum and indexer also allows the apparatus to be easily mechanised.

The indexer may comprise a radially extending dividing member mounted centrally on the drum having a passage therein such that the strand of material may be fed onto the drum on alternating sides of the dividing member by periodically extending the strand through the passage for forming first and second portions of the coil adjacent the respective sides of the dividing member.

A clasp is preferably mounted on the dividing member arranged to secure an inner end of the strand thereon such that the inner end of the strand extends radially outward from the coil between the first and second portions of the coil past a periphery of the coil once the coil has been wound.

Preferably the dividing member is selectively separable from the drum such that removal of the dividing arm allows the coil to be removed from the drum by sliding the coil past one end of the drum in an axial direction.

According to a second aspect of the present invention there is provided an apparatus for winding an elongate strand of material into a coil, the apparatus comprising;

a drum supported for rotational movement, the drum having a peripheral surface with a first end, a second end opposite the first end and a crossover point on the peripheral surface spaced between the first and second ends; and indexer means for producing relative axial movement between the strand and the drum as the strand is wound onto the peripheral surface of the drum past the crossover point for dividing the strand into a first portion between the first end and the crossover point and a second portion between the second end and the crossover point.

The indexer means may comprise an oscillator connected to the drum for oscillating the drum in an axial direction as the drum is rotated.

There may be provided a guide member for feeding the strand of material to the drum member from a fixed location.

When the indexer means comprises an oscillator, there may be provided a motor connected to the oscillator for coordinating rotary and oscillatory motions of the drum such that the drum is axially displaced from a central position to one end position and back to the central position with each full rotation of the drum.

In a further arrangement the indexer means may comprise a shaft mounting the drum thereon for rotation about a longitudinal shaft axis, the drum being mounted about a longitudinal drum axis which is angularly offset from the longitudinal shaft axis such that the drum rotates in a wobbling pattern for forming first and second portions of the coil as the strand of material is wound onto the drum.

The indexer means may further comprise a guide member mounted for oscillating movement about a guide axis which is parallel to a longitudinal axis of the drum, the guide member being arranged to feed the strand of material to the drum at varying longitudinal positions along the drum as the drum is rotated.

Preferably there is provided an oscillator for oscillating the guide member as the drum rotates.

There may be provided drive means connected to the oscillator for coordinating rotary motion of the drum with oscillatory motion of the guide member such that the guide member is axially displaced from a central position to an end position in alignment with a corresponding end of the drum and back to the central position with each full rotation of the drum.

According to a further aspect of the present invention there is provided a coreless package of an elongate strand of material having an inner end and an outer end, the package comprising:

a plurality of sets of first loops of the strand of material forming a first coil, each set of first loops comprising at least one loop; and a plurality of sets of second loops of the strand of material forming a second coil adjacent the first coil, each set of second loops comprising at least one loop, the strand of material passing between the first and second coils between the sets of loops such that the first and second coils are formed intermittently.

The inner end of the strand of material is preferably arranged to extend radially between the first and second coils such that the strand of material may be dispensed without twisting by pulling the inner end from the coils.

The strand of material is preferably formed into the first and second loops in an alternating arrangement such that the strand of material extends between the first and second coils after each loop at a crossover point between the coils. Preferably the number of first loops is substantially equal to the number of second loops. The first and second coils are preferably wound about respective axes, the axes being substantially co-linear.

According to a further aspect of the present invention there is provided a method of winding an elongate strand of material into a coiled package for later dispensing the strand without twisting of the strand, the method comprising:

A) forming at least one first loop of the strand into a first coil;

B) forming at least one second loop of the strand into a second coil adjacent the first coil;

C) repeating steps A and B until the strand of material is substantially completely wound; and D) inserting an inner end of the strand between the first and second coils such that the inner end of the strand extends radially past a periphery of the first and second coils for dispensing the strand of material by the inner end.

The first and second loops may be alternately formed such that the strand extends between the first and second coils after each first and second loop at a crossover point located at a periphery of the coils between the first and second coils.

Forming each of the first and second loops may comprise winding the strand of material onto a drum.

BRIEF DESCRIPTION OF THE DRAWINGS

In the accompanying drawings, which illustrate an exemplary embodiment of the present invention.

DETAILED DESCRIPTION

Figure 1:
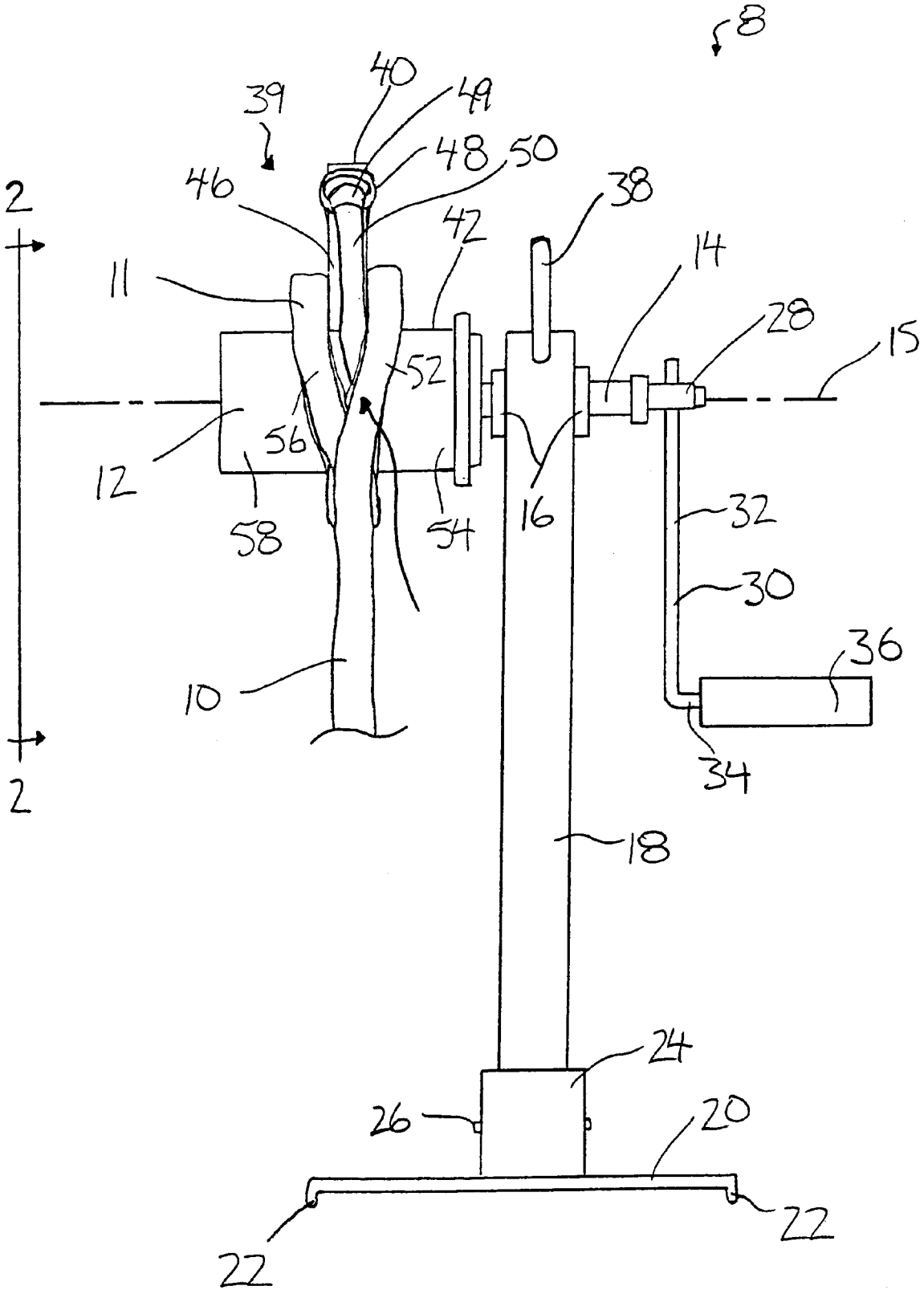
FIG. 1 is a front elevational view of a first embodiment of the hose winding apparatus.
Figure 3:
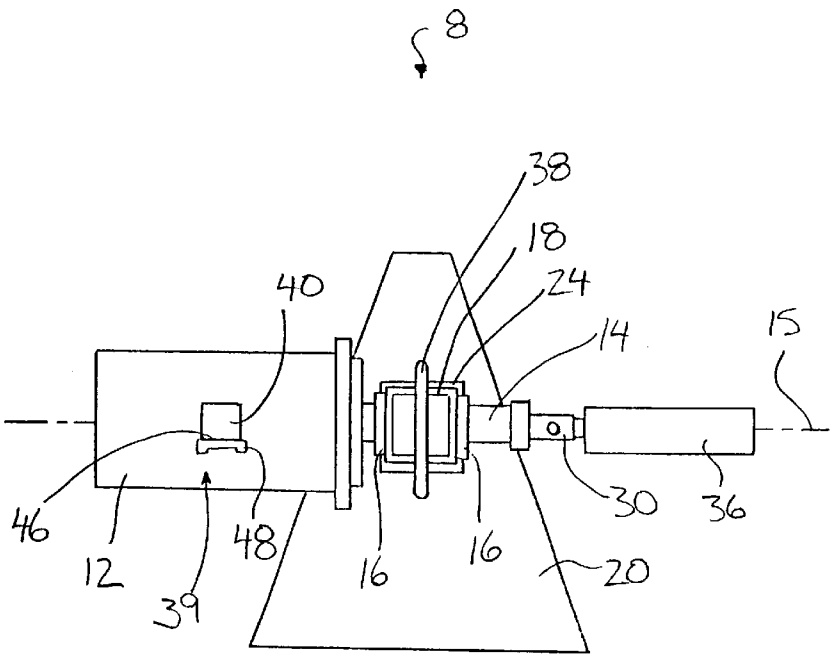
FIGS. 2 and 3 are respective side elevational and top plan views of the hose winding apparatus according to FIG. 1.
Figure 2:
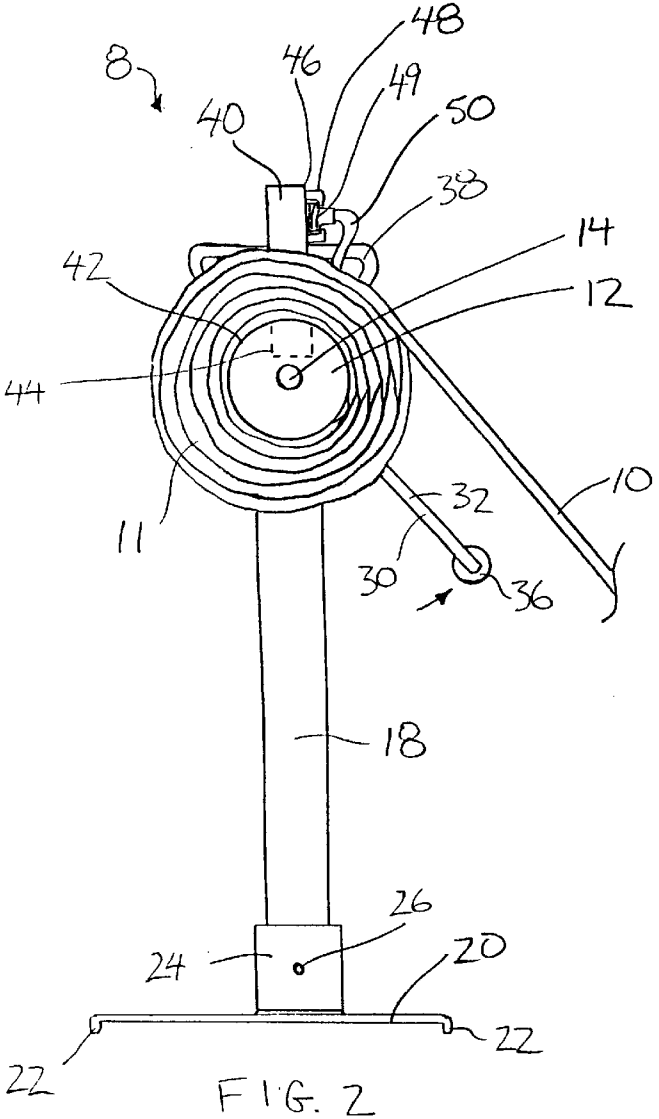

Referring to the accompanying drawings, there is illustrated a hose winding apparatus generally indicated by reference numeral 8. The hose winding apparatus 8 is arranged to wind hose 10 thereon into an open core hose package 11 such that the hose may be later dispensed from the hose package without unwanted twisting.

The apparatus 8 includes a cylindrical drum 12 for winding the hose thereon. The drum 12 is mounted coaxially on a shaft 14 for rotation about a longitudinal axis 15 extending through both the drum and the shaft. The shaft 14 is supported on bearings 16 mounted on a top end of a post 18. The post 18 is a rigid upright member of rectangular cross section which supports the shaft 15 such that the longitudinal axis 15 is generally horizontal.

The post 18 is mounted at a bottom end on a base plate 20. The base plate 20 is a triangular shaped plate having a foot 22 at each apex for supporting the base plate on the ground. A collar 24 is welded onto a top side of the base plate for receiving the bottom end of the post 18 therein. A locking member 26 extends through co-operating apertures in both the post 18 and the collar for securing the post in the collar. In this arrangement, the base plate is selectively separable from the post for compact storage and transport of the apparatus.

An end 28 of the shaft 14 opposite the drum 12 mounts a crank 30 thereon for driving the rotation of the shaft and the drum. The crank 30 includes a first portion 32 extending radially from the shaft and a second portion 34 mounted on an outer end of the first portion parallel to the shaft. The second portion 34 rotatably mounts a sleeve 36 thereon for grasping by a hand of a person.

A handle 38 mounts on the top end of the post 18 for carrying the apparatus.

An indexer 39 in the form of dividing arm 40 is mounted on the drum 12 to extend radially outward from a peripheral surface 42 of the drum at a position spaced between the opposite ends of the drum. The dividing arm 40 is a tube of rectangular cross section which is slidably received in an aperture 44 in the peripheral surface of the drum. A forward face 46 of the dividing arm includes a clasp 48 mounted towards an outer end thereof. The clasp 48 includes a pair of arms arranged to clamp a socket 49 of an inner end 50 of the hose 10 therebetween. As the hose is wound onto the drum the hose secures the dividing arm within the aperture 44 due to the attachment of the inner end 50 of the hose on the arm.

In use, the socket 49 of the inner end of the hose is mounted on the clasp 48. Manually turning the crank 30 will rotate the drum for wrapping the hose about the drum. As the hose is wrapped onto the drum, the hose is fed to alternating sides of the dividing arm 40 after each full rotation of the drum until the hose is substantially completely wound onto the drum. The hose is crossed over from a first side of the dividing arm to a second side of the dividing arm at a crossover point 51 on the peripheral surface of the drum opposite the dividing arm.

Figure 4:
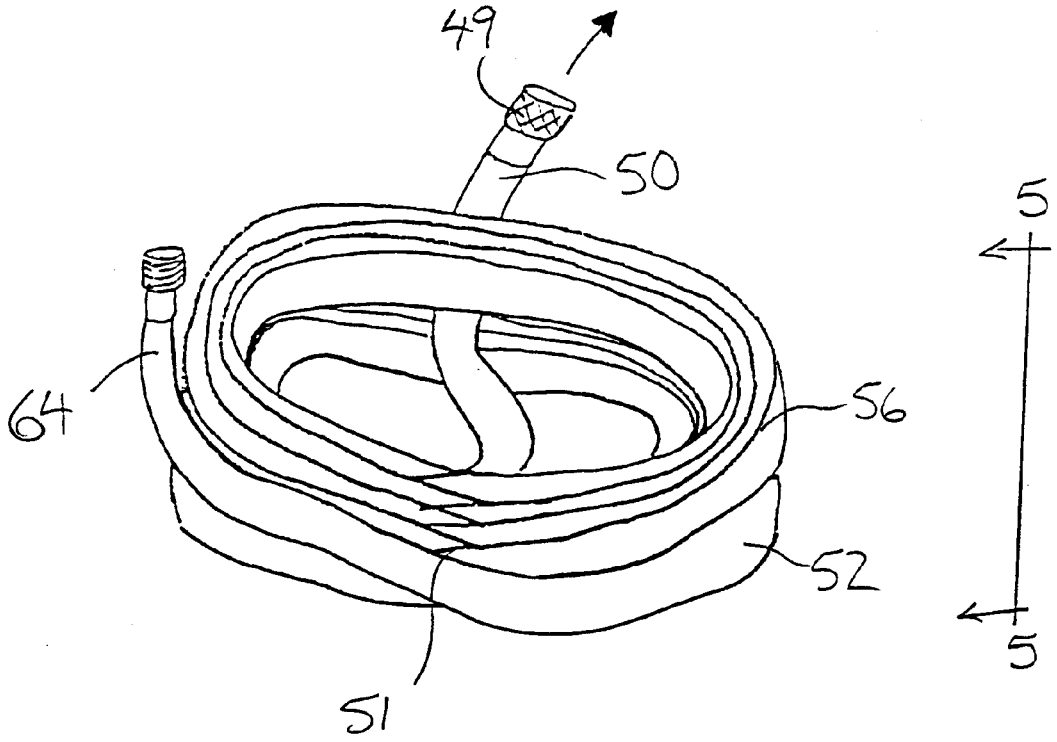
FIG. 4 is an isometric view of a coil for hose which has been wound using the hose winding apparatus.
Figure 5:
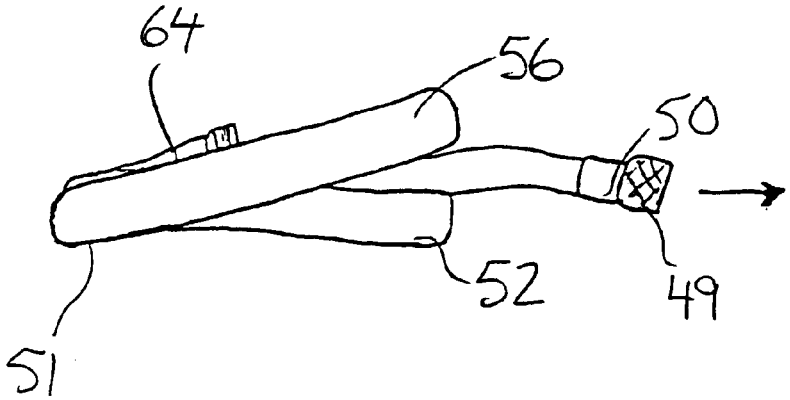
FIG. 5 is a side elevational view of the coil of hose along the line 5—5 of FIG. 4.

The hose thus forms a plurality of first loops 52 about a first end 54 of the drum forming a first coil and a plurality of second loops 56 about a second end of the drum 58 forming a second coil. When the hose is fed to alternating sides of the dividing arm, the number of first and second loops will be substantially equal. Each first loop is connected at respective ends between a pair of second loops at the crossover point. The first and second loops 52, 56 are thus intertwined at the crossover point 51 to form the hose package 11 as shown in FIGS. 4 and 5. The first and second coils are wound about respective axes with the axes being substantially collinear. In this arrangement the coils form a compact open core hose package.

The hose package 11 is removed from the drum by detaching the inner end of the hose from the clasp 48 such that the dividing arm 40 can be removed from the drum. Once the dividing arm has been removed, the hose package 11 is slid off the end of the drum.

The hose package forms a tight coil of hose which holds its form for dispensing the hose therefrom without the use of additional equipment such as a reel. Due to the arrangement of the hose package capable of drawing out hose from an inner end first, the hose package can be tightly mounted in any type of container having an opening for passing the hose therethrough as the hose package does not require rotation or displacement of any kind as the hose is dispensed.

Figure 9:
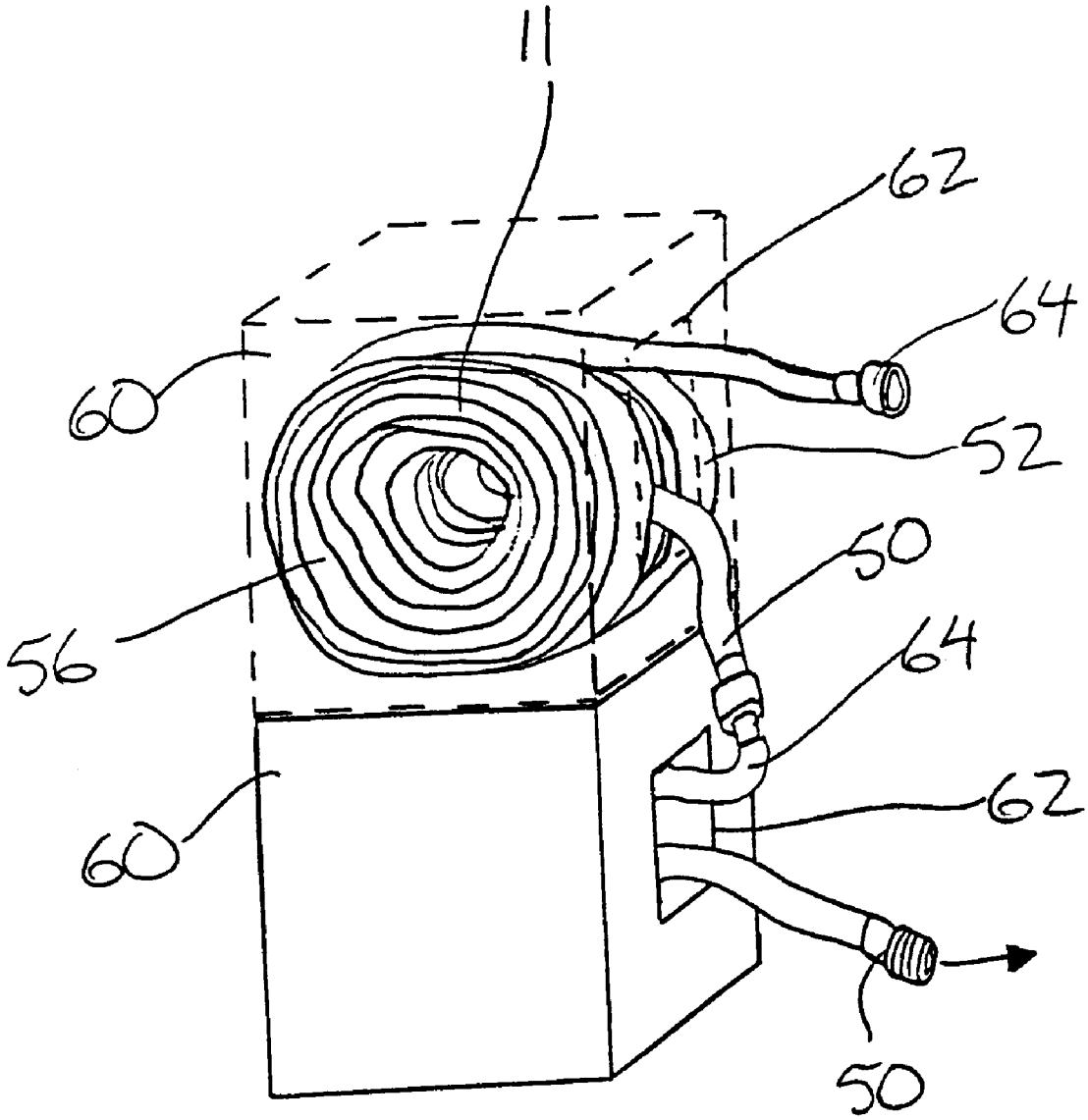
FIG. 9 is an isometric view of an apparatus for dispensing coils of hose which have been wound using the hose winding apparatus of the present invention.

A dispenser 60 for dispensing multiple hose packages in series is shown in FIG. 9. The dispenser 60 is a container which is appropriately sized for storing one of the hose packages therein. An aperture 62 in a side of the dispenser is arranged to receive both the inner end 50 and an outer end 64 of the hose therethrough. The outer end 64 may then be secured to the inner end 50 of a hose package mounted in an adjacent dispenser 60.

In use, the inner end 50 of the hose package from a first one of the dispensers is pulled from the dispenser for drawing the hose out of the dispenser through the aperture 62. The hose may be continuously drawn out of the dispenser without any twisting as the hose is being alternately drawn from either the first or second plurality of loops. Once the hose has been completely drawn out, the outer end 64 of the hose package will begin to pull on the inner end 50 of the adjacent hose package connected thereto. The adjacent hose package will thus be similarly drawn out. Any number of the dispensers can be connected in series for drawing out numerous desired lengths of hose.

Figures 6, 7, 8:
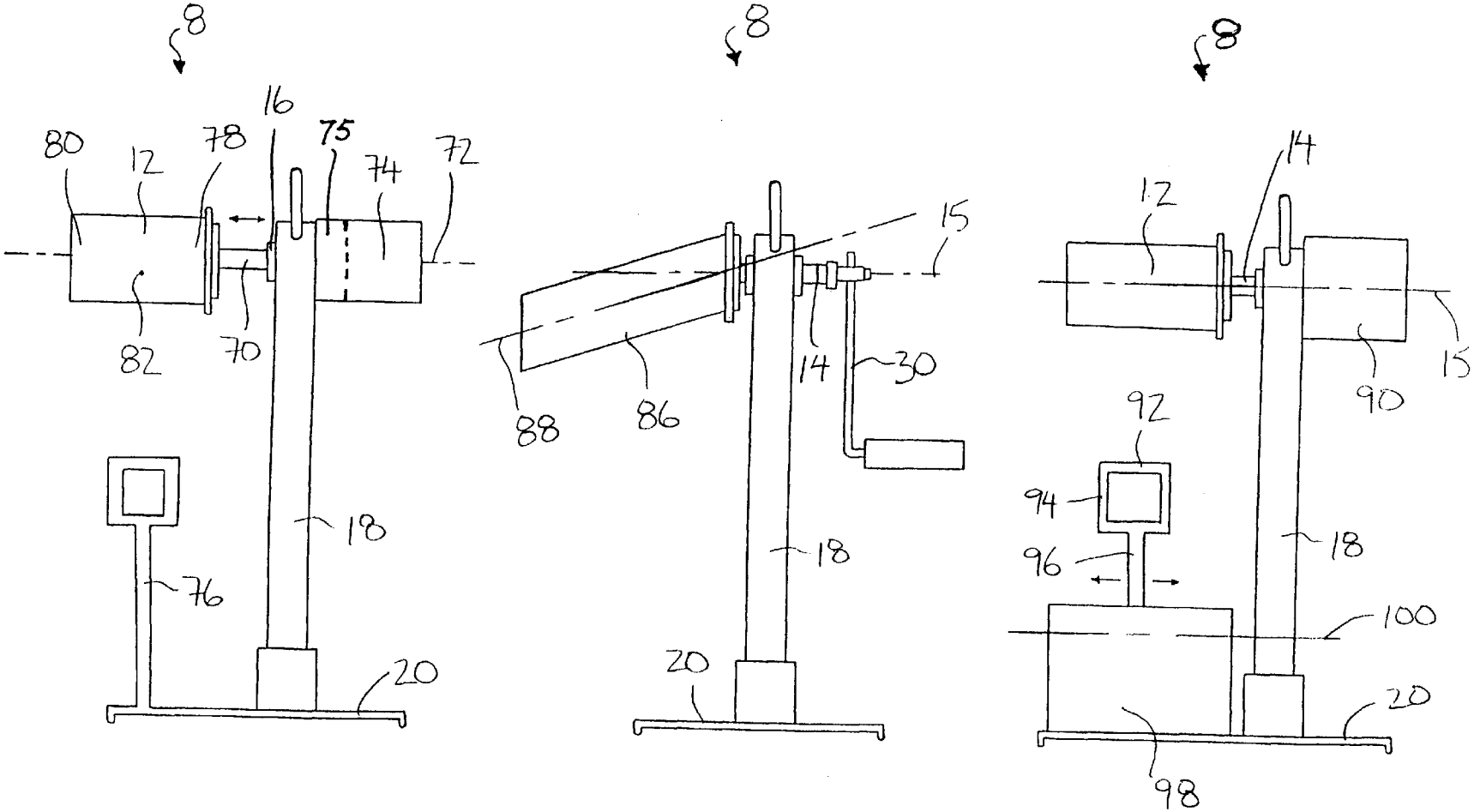
FIGS. 6, 7 and 8 are front elevational views of various embodiments of the hose winding apparatus.

The apparatus 8 used for winding hose into the hose package which is shown in FIGS. 4 and 5 may take several forms. An alternative embodiment of the apparatus is shown in FIG. 6 wherein the drum 12 is a solid cylindrical member which is not arranged to mount a dividing arm thereon. The shaft 70 which supports the drum is mounted for sliding movement along a longitudinal axis 72 by bearings 16. The crank 30 is replaced by an electric motor 74 and oscillator 75 which are arranged to drive the rotational and sliding movement of the shaft 70 relative to the post 18.

A guide member 76 is mounted on the base plate 20 for feeding the hose to the drum 12 from a fixed position. The guide member 76 includes a stem extending upward from the base plate and ring mounted on the stem for receiving the hose therethrough. The drum is thus arranged to oscillate longitudinally relative to the guide member for feeding the hose onto the drum as it rotates at different longitudinal positions along the drum. The apparatus 8 is otherwise arranged similarly as in the first embodiment.

The drum 12 includes a first end 78, a second end 80 and a crossover point 82 located on the peripheral surface of the drum at a location spaced between the first and second ends. The oscillations of the drum are arranged such that the each full rotation begins at a central position as shown in FIG. 6 with the crossover point aligned with the guide member. In a first cycle, the motor 74 drives the drum to complete a full rotation with the guide member aligned with that part of the drum between the first end and the crossover point, wherein the rotation starts from the central position. In a second cycle the motor 74 then drives the drum to complete a full rotation with the guide member aligned with that part of the drum between the second end and the crossover point, wherein the rotation also starts from the central position. The motor 74 is arranged to drive the drum in an alternating pattern between the first and second cycles for winding the hose onto the drum such that the hose package of FIGS. 4 and 5 is formed.

A further embodiment of the hose winding apparatus 8 is shown in FIG. 7. The apparatus 8 is arranged similarly to the first embodiment with the exception of the drum. The drum 86 of FIG. 7 is mounted about a drum axis 88 which is angularly offset from the longitudinal axis 15 of the shaft 14. The drum is fixed in relation to the shaft such that the drum rotates with the shaft about the longitudinal axis of the shaft. The drum will thus rotate in a wobbling pattern such that as the hose is fed onto the drum the hose forms first and second coils as shown in FIGS. 4 and 5.

Another embodiment of the hose winding apparatus 8 is shown in FIG. 8. The apparatus of FIG. 8 includes the drum 12 mounted coaxially on the shaft 14 for rotation about the longitudinal axis 15 as in the first embodiment. An electric motor 90 is provided for driving the rotation of the drum. A guide member 92 is mounted on the base plate 20 for indexing the hose as it is wound onto the drum. The guide member includes a ring 94 for guiding the hose therethrough and a stem 96 for supporting the ring spaced upward from the base plate in alignment with the drum.

An oscillator 98 mounts the guide member 92 for oscillating the guide member along an oscillator axis 100 between respective ends of the drum. The oscillator axis 100 is parallel to the longitudinal axis 15 of the drum and shaft. The oscillator 98 is coordinated with the motor 90 for oscillating the guide member from one end of the drum to the other with each full rotation of the drum. The hose package which results will take the form described in FIGS. 4 and 5.

The oscillator includes a cam or crank element connected to the rotation of the motor for driving both the rotation of the drum and the oscillation of the guide member. Adjustment of the gearing between the cam element and the motor will control the frequency that the guide member will alternate between respective ends of the drum member.

While various embodiments of the present invention have been described in the foregoing, it is to be understood that other embodiments are possible within the scope of the invention. For example, the dividing arm of the first embodiment may take the form a plate extending radially from the drum through a portion of the circumference of the drum as well as numerous other shapes of members which are detachable from the drum. Other possible variations to the apparatus include variations to the shape and orientation of the drum. The invention is to be considered limited solely by the scope of the appended claims.

What is claimed is:

1. An apparatus for winding an elongate strand of material into a coil, the apparatus comprising;

a drum supported for rotational movement, the drum having a peripheral surface with opposite first and second ends and a crossover point on the peripheral surface spaced between the first and second ends; and a dividing member mounted on the drum and projecting radially from the peripheral surface at a position circumferentially spaced from the crossover point such that the strand of material may be wound onto the drum with alternate turns on opposite sides of the dividing member by passing the strand across the crossover point between sequential turns, whereby first and second portions of the coil are formed on the opposite of the dividing member, the dividing member being selectively separable from the drum such that removal of the dividing member allows the coil to be removed from the drum by sliding the coil past one end of the drum in an axial direction.

2. The apparatus according to claim 1 wherein there is provided a clasp on the dividing member arranged to secure an inner end of the strand thereon such that the inner end of the strand extends radially outward from the coil between the first and second portions of the coil past a periphery of the coil once the coil has been wound.

3. An apparatus according to claim 1, including:

indexer means for producing relative axial movement between the strand and the drum as the strand is wound onto the peripheral surface of the drum past the cross-over point.

4.The apparatus according to claim 3 wherein the indexer means comprises an oscillator connected to the drum for oscillating the drum in an axial direction as the drum is rotated.

5. The apparatus according to claim 4 wherein there is provided a guide member for feeding the strand of material to the drum member from a fixed location.

6. The apparatus according to claim 4 wherein there is provided a motor connected to the oscillator for coordinating rotary and oscillatory motions of the drum such that the drum is axially displaced from a central position to one end position and back to the central position with each full rotation of the drum.

7. The apparatus according to claim 3 wherein the indexer means comprises a guide member mounted for oscillating movement along a guide axis which is parallel to a longitudinal axis of the drum, the guide member being arranged to feed the strand of material to the drum at varying longitudinal positions along the drum as the drum is rotated.

8. The apparatus according to claim 7 wherein there is provided an oscillator for oscillating the guide member as the drum rotates.

9. The apparatus according to claim 8 wherein there is provided drive means connected to the oscillator for coordinating rotary motion of the drum with oscillatory motion of the guide member such that the guide member is axially displaced from a central position toward one end of the drum and back to the central position with each full rotation of the drum.

10. A dispensing package of an elongate material, the package comprising:

a container having an access opening;

a coreless coil assembly of the elongate material within the housing, the coil assembly comprising a strand of the elongate material having inner and outer ends and being wound to form:

a plurality of first loops of the strand of material forming a first coil; and a plurality of second loops of the strand of material forming a second coil adjacent the first coil, the strand passing between the first and second coils between sequential loops such that the first and second coils are formed intermittently, the inner and outer ends of the strand extending through the access opening of the container.

11. The package according to claim 10 wherein the inner end of the strand of material extends radially between the first and second coils such that the strand of material may be dispensed without twisting by pulling the inner end from the coils.

* * * * *